US007874922B2

(12) United States Patent
Kasuya

(10) Patent No.: US 7,874,922 B2
(45) Date of Patent: Jan. 25, 2011

(54) GAME SYSTEM AND GAME PART

(75) Inventor: Yasufumi Kasuya, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 743 days.

(21) Appl. No.: 11/813,473

(22) PCT Filed: Dec. 26, 2005

(86) PCT No.: PCT/JP2005/023723

§ 371 (c)(1),
(2), (4) Date: Aug. 8, 2007

(87) PCT Pub. No.: WO2006/073074

PCT Pub. Date: Jul. 13, 2006

(65) Prior Publication Data

US 2008/0139320 A1 Jun. 12, 2008

(30) Foreign Application Priority Data

Jan. 6, 2005 (JP) ..... 2005-001624

(51) Int. Cl.
*A63F 9/24* (2006.01)

(52) U.S. Cl. ..... 463/43; 463/46

(58) Field of Classification Search ..... 463/43, 463/46

See application file for complete search history.

(56) References Cited

U.S. PATENT DOCUMENTS

2005/0119054 A1* 6/2005 Izawa et al. ..... 463/46
2007/0054443 A1* 3/2007 Shimomura ..... 438/149
2007/0259993 A1* 11/2007 Yamaguchi ..... 523/324

FOREIGN PATENT DOCUMENTS

| | | | |
|---|---|---|---|
| JP | 10-314444 | A | 12/1998 |
| JP | 2000-288238 | A | 10/2000 |
| JP | 2000-330432 | A | 11/2000 |
| JP | 2001-070630 | A | 3/2001 |
| JP | 2001-358867 | A | 12/2001 |

(Continued)

*Primary Examiner*—Pierre E Elisca
(74) *Attorney, Agent, or Firm*—Edwards Angell Palmer & Dodge LLP; Peter C. Schechter; Brian R. Landry

(57) ABSTRACT

The present invention provides a game system in which a maintenance property of a game part of a game machine is improved.

A game part D has a replacement determination device 35 and a replacement information output device 32. The replacement determination device 35 measures a parameter indicating a used amount of the game part D in a game, accumulates a value of the measured parameter RD, specifies a wearing level of a consumable item 38 of the game part D based on the determined accumulation value, and checks the specified wearing level to a criterion wearing level to determines whether or not it is replacement time to replace the consumable item 38. When the replacement determination device 35 determines that it is the replacement time, the replacement information output device 32 outputs replacement information to a game machine main body K. The game machine main body K has replacement processing device 27. The replacement processing device 27 performs a process concerning the replacement of the consumable item 38 of the game part D which has output the obtained replacement information.

20 Claims, 15 Drawing Sheets

FOREIGN PATENT DOCUMENTS

| | | | |
|---|---|---|---|
| JP | 2002-063649 | A | 2/2002 |
| JP | 2002-169705 | A | 6/2002 |
| JP | 2002-351270 | | 12/2002 |
| JP | 2003-033564 | A | 2/2003 |
| JP | 2003-033567 | A | 2/2003 |
| JP | 2003-038841 | A | 2/2003 |

* cited by examiner

FIG. 12

| D CODE | STORE NAME |
|---|---|
| * * * * * * | * * * * * * * * * |

ERROR LOG

| | | |
|---|---|---|
| e−23X | 2004/10/10 9:25 | |
| * | * | |
| * | * | |
| * | * | |
| * | * | |
| * | * | |
| * | * | |
| * | * | |
| * | * | |

FIG. 13

MONITERING OPERATIONAL STATUS IN EACH STORE

| D CODE | STORE NAME | NUMBER OF ERROR OCCURRENCES／DAY | NUMBER OF WARNING OCCURRENCES／DAY |
|---|---|---|---|
| ******* | ******* | 80 | 150 |
| ******* | ******* | 70 | 100 |
| ******* | ******* | 60 | 80 |
| ******* | ******* | 50 | 70 |
| ******* | ******* | 10 | 30 |
| ******* | ******* | 0 | 10 |
| ******* | ******* | 0 | 3 |
| ******* | ******* | 0 | 0 |

FIG. 14

ERROR OCCURRENCE STATUS OF EACH SELF-PROPELLED BODY

| | LINE OUT | TURN OVER | MOVE DELAY | LINE SKIP | DIST SKIP | POWER FAIL | GEAR UNIT OPERATING TIME | MOTOR UNIT OPERATING TIME |
|---|---|---|---|---|---|---|---|---|
| ID1 | | | | | | | | |
| ID2 | | | | | | | | |
| ID3 | | | | | | | | |
| ID4 | | | | | | | | |
| ID5 | | | | | | | | |
| ID6 | | | | | | | | |
| ID7 | | | | | | | | |
| ID8 | | | | | | | | |
| ID9 | | | | | | | | |
| ID10 | | | | | | | | |
| ID11 | | | | | | | | |
| ID12 | | | | | | | | |

GAME SYSTEM AND GAME PART

CROSS-REFERENCE TO PRIOR APPLICATIONS

This is a U.S. national phase application under 35 U.S.C. §371 of International Patent Application No. PCT/JP2005/023723, filed Dec. 26, 2005, which claims the benefit of Japanese Application No. 2005-001624, filed Jan. 6, 2005, both of which are incorporated by reference herein. The International Application was published in Japanese on Jul. 13, 2006 as International Publication No. WO 2006/073074 A1 under PCT Article 21(2).

TECHNICAL FIELD

The present invention relates to a game system and a game part used in the game system.

BACKGROUND ART

There is well known a game machine, in which a self-propelled body for pulling a model body through a field surface with a magnetic force is provided and the self-propelled body travels to play a traveling game (for example, see Patent Documents 1 to 4). A lower surface of the field surface is provided as a power supply surface for the self-propelled body, and the self-propelled body is caused to travel while being in contact with the power supply surface, which allows the power supply to the self-propelled body and traveling to be simultaneously performed.

Patent Document 1: Japanese Patent Application Laid-Open No. 2003-33564

Patent Document 2: Japanese Patent Application Laid-Open No. 2003-38841

Patent Document 3: Japanese Patent Application Laid-Open No. 2003-33567

Patent Document 4: Japanese Patent Application Laid-Open No. 2000-288238

DISCLOSURE OF THE INVENTION

PROBLEM TO BE SOLVED BY THE INVENTION

When a traveling time of the self-propelled body reaches a predetermined value or more, for example, a power supply unit which is always in contact with the power supply surface is worn, or a gear and a bearing associated with travel are consumed. However, in a usual game system, as a replacement time of such consumable items, only a general replacement time is described in an instruction manual or the like. Accordingly, it is necessary that a user be always conscious of the replacement time described in the instruction manual. Even if the user is conscious of the replacement time, when the game system is more frequently used than usual, the consumable items are consumed earlier. Then, the consumable items are replaced after the game system becomes inoperative. Additionally, even in the case where a service staff of a game system notifies the user of the replacement time, because it is hard for the service staff to cognizes a status of use, the service staff notifies the user only of the replacement time corresponding to a usual use. Therefore, in a conventional game system, there is a problem in terms of maintenance.

In view of the foregoing, an object of the invention is to provide a game system in which a maintenance property of the game machine part is improved.

MEANS FOR SOLVING THE PROBLEM

In order to solve the problem, the present invention provides a game system having a game machine in which a predetermined game is performed, the game machine having a game machine main body and a replaceable game part provided in the game machine main body to be used in the game machine, the replaceable game part having a consumable item which is replaceable and consumed by use in the game, wherein the game part has: a criterion storage device for storing a criterion wearing level indicating a wearing level at which the consumable item should be replaced; a measurement device for measuring a parameter indicating a used amount of the game part in the game; an accumulation device for accumulating a value of the parameter measured by the measurement device; a wearing level specifying device for specifying the wearing level of the consumable item of the game part based on an accumulation value obtained by the accumulation device; a replacement determination device for checking the wearing level specified by the wearing level specifying device to the criterion wearing level of the criterion storage device to determine whether or not it is replacement time to replace the consumable item and a replacement information output device for outputting replacement information on replacement of the consumable item to the game machine main body, when the replacement determination device determines that it is replacement time to replace the consumable item. The game machine main body has: a replacement information obtaining device for obtaining the replacement information outputted from the game part; and a replacement processing device for performing a process concerning a replacement of the consumable item of the game part based on the replacement information obtained by the replacement information obtaining device, the game part having output the replacement information.

According to the game system of the present invention, in the game part, the used amount of the game part in the game is obtained as the accumulation value of the specific parameters, the wearing level of the consumable item provided in the game part is specified based on the accumulated used amount, and it is determined whether or not it is a replacement time to replace the consumable item, by checking the specified wearing level to the criterion wearing level determined as a wearing level of the replacement time.

All of the measurement device, the accumulation device, and the wearing level specifying device which specify the wearing level of the consumable item are provided in the game part. Therefore, even if the one game part is used in the plural different game machines, the wearing level to which the used amount for each game machine is added can be specified. Accordingly, according to the present invention, the game part can determine by itself whether or not it is the replaceable time, and the game part can notify the chassis of the replacement information.

Examples of the process concerning the replacement performed in the game machine main body include a process of displaying the replacement information such that the user can recognize the replacement information and a process of transferring the replacement information to a maintenance service division. The wearing level may be specified only by the accumulation value, or the wearing level may be specified by referring to other pieces of information in addition to the accumulation value. The information on the replacement may include information indicating the consumable item which is a replacing object and information on the replacement time as well as advertisement of the part associated with the consumable item which is the replacing object and the value of the parameter used to compute the wearing level.

In the game system according to the invention, the game machine main body may have a server communication device capable of transmitting and receiving data to and from a server through a communication network, and the replacement processing device of the game machine main body may notify a user of information on the replacement of the consumable item based on the obtained replacement information, and transmit the replacement information to the server. Thereby, the replacement information can be used in another process in the server while being notified to the user.

Further, the game machine main body may have a game machine storage device for storing game machine identification information uniquely given to each game machine in the game system, and the replacement processing device may transmit to the server, the replacement information including the game machine identification information of the game machine corresponding thereto. Thereby, even if the plural game machines exist in the game system, each game machine can be identified in the game system.

In the game system according to the present invention, the server may transmit to the game machine main body, the criterion change information including information for changing the criterion wearing level, the game machine main body may have a change information output device for outputting the criterion change information to the game part at the moment of receiving the criterion change information from the server, and the game part may have: a change information obtaining device for obtaining the criterion change information from the game machine main body; and a criterion change device for changing the criterion wearing level stored in the criterion storage device based on the criterion change information obtained by the change information obtaining device. Thereby, when the criterion change information is transmitted from the server the game machine main body, contents of the criterion wearing level held by the game part provided in the game machine can be changed. The criterion change information is transmitted by, for example, a predetermined operation to the server performed by the user using the maintenance client.

the game part may has a part identification information storage device for storing part identification information uniquely given to each game part in the game system, the replacement information output device may transmit to the game machine main body, the replacement information including the part identification information of the game part corresponding thereto, the criterion change device, when the criterion change information includes the part identification information of the game part corresponding thereto, may change the criterion wearing level based on the criterion change information, and the criterion change information transmitted from the server may include the part identification information corresponding to the game part in which the criterion wearing level of a changing object is stored. Thereby, even if the plural game parts are provided in one game machine, the game part can be identified in the game system by the part identification information.

the game part may be a movable body, the game machine main body may have a part communication device for transmitting and receiving control information on operation control of the game part to and from the game part, and the game part may have: a game machine communication device for transmitting and receiving the control information on operation control of the game part to and from the game machine main body; and an operation control device for controlling operation of the game part based on the control information transmitted from the game machine main body. In the game system, the part communication device can be used when the game machine main body transmits and receives information to and from the game part, and the game machine communication device can be used when the game part transmits and receives information to and from the game machine main body.

The game machine may have a traveling surface, and the game part may be a self-propelled body traveling on the traveling surface. Thereby, the present invention can be applied to the game machine where the traveling race is performed and the game part.

In order to solve the problem, a game part according to the present invention replaceably provided in a game machine to be used in a game, which is performed in the game machine, and having a replaceable consumable item to be consumed by use in the game, the game part having: a criterion storage device for storing a criterion wearing level indicating a wearing level at which the consumable item should be replaced; a measurement device for measuring a parameter indicating a used amount of the game part in the game; an accumulation device for accumulating a value of the parameter measured by the measurement device; a wearing level specifying device for specifying the wearing level of the consumable item of the game part based on an accumulation value determined by the accumulation device; are placement determination device for checking the wearing level specified by the wearing level specifying device to the criterion wearing level of the criterion storage device to determine whether or not it is replace time to replace the consumable item; and a replacement information output device for outputting replacement information on replacement of the consumable item to the game machine main body, when the replacement determination device determines that it is replace time to replace the consumable item. The game system of the present invention can be realized by the game part.

As described above, according to the present invention, the game part specifies the wearing level of the consumable item provided in the game part based on the used amount indicating the amount that the game part is used in the game, the game part determines whether or not it is the replacement time based on the specified wearing level, and the game part outputs the replacement information when the game part determines that it is the replacement time. Therefore, the invention can provide the game system, in which the user can properly recognize the replacement time of the consumable item provided in the game part and the maintenance property of the game machine part is improved.

BRIEF DESCRIPTION OF THE DRAWINGS

FIG. 12 is a diagram showing an example of a list generated by a maintenance server in the trouble notification system shown in FIG. 10;

FIG. 13 is a diagram showing another example of the list generated by the maintenance server in the trouble notification system shown in FIG. 10;

FIG. 14 is a diagram showing another example of the list generated by the maintenance server in the trouble notification system shown in FIG. 10.

BEST MODE FOR CARRYING OUT THE INVENTION

Figure 1:
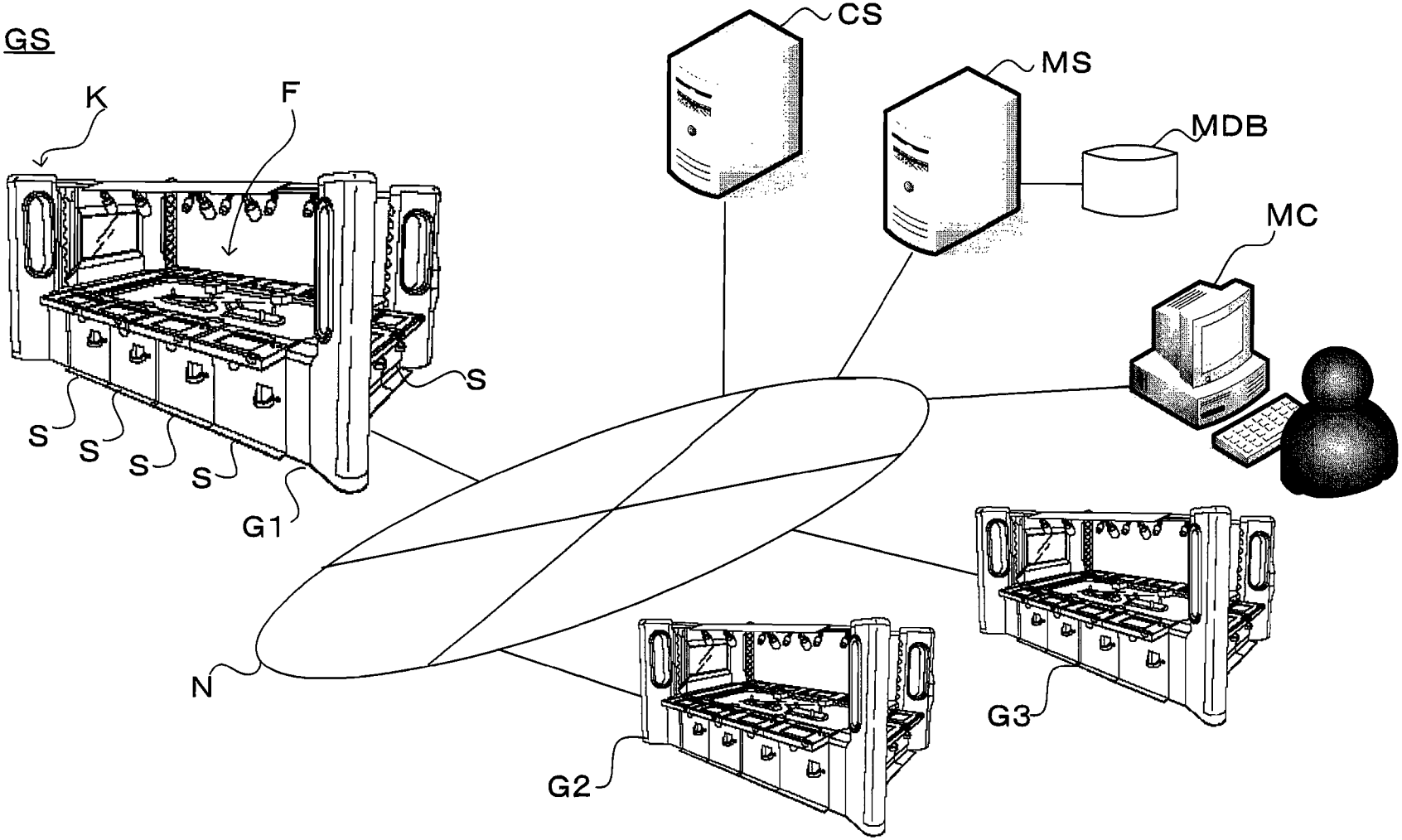
FIG. 1 shows an embodiment of a game system according to the present invention.

FIG. 1 is a diagram showing a schematic configuration of a game system GS according to an embodiment of the invention. The game system GS includes plural game machines G1, G2, and G3, a center server CS, a maintenance server MS, and a maintenance client MC. The game machines G1 to G3, the servers CS, MS and the client MC are connected to one another through a communication network N. The plural game machines G1 to G3 in the game system GS have the same configuration. Accordingly, each of the plural game machines G1 to G3 is referred to as "the game machine G" at the moment when the distinction is not needed. Although the three game machines G are shown in FIG. 1, the number of game machines G included in the game system GS is not limited to this embodiment.

The center server CS mainly processes data concerning a game according to a request of the game machine G. The maintenance server MS stores data concerning the maintenance such as error log information on the game system GS in a maintenance storage unit MDB which is a storage unit of the maintenance server MS, and the maintenance server MS manages the data concerning the maintenance. The maintenance client MC is installed in a maintenance service division which collectively manages the maintenance of the game system GS, the maintenance client MC performs analysis and study of the maintenance of the game system GS by using the data stored in the maintenance storage unit MDB. The Internet is used as the communication network N. The game machine G is a commercial game machine which is installed in a game arcade or a store having a game corner. A field F where the game is played is provided in a chassis K which is of a game machine main body of the game machine G, and plural stations S, . . . , S which receive operations of players are arranged around the field F.

Figure 2:
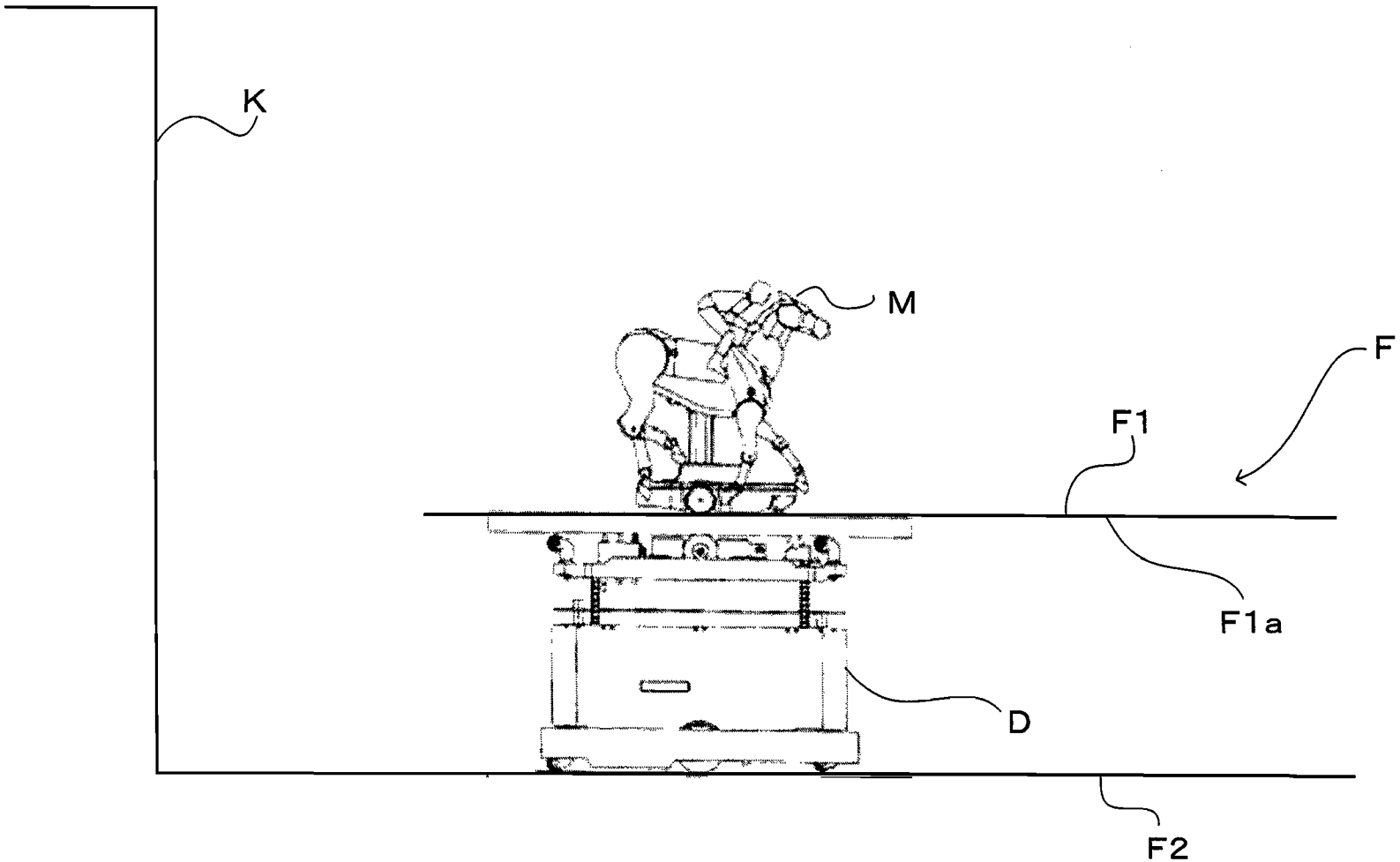
FIG. 2 shows a self-propelled body provided in a game machine shown in FIG. 1.

As shown in FIG. 2, the field F has an upper traveling-field F1 and a lower traveling-field F2. A self-propelled body D as a replaceable part and a game part is provided on the lower traveling-filed F2, and the self-propelled body D is connected to a model body M through the upper traveling filed F1 by the magnetic force. A line guided competition game is performed in the game machine G. In the line guided competition game, the plural self-propelled bodies D travel while tracking guide lanes provided on the lower traveling-field F2, and thereby each of the self-propelled bodies D pulls the corresponding model body M. In this embodiment, the model body M is a model horse, and the line guided competition game is performed as a horse race with six model horses. The line guided competition race progresses by data transmission and reception performed between the self-propelled body D and the chassis K. In this embodiment, infrared ray is used as a carrier wave of the data transmission and reception. Each of the chassis K and the self-propelled body D controls the operation of itself based on the received data. A conventional method may be employed as the control method.

A backside F1*a* of the upper traveling-field F1 is the power supply surface in which a power supply line for supplying electric power to the self-propelled body D is provided. Hereinafter the line guided competition game performed in the game machine G is simply referred to as "the game" or "the race". A participant of the game is referred to as "the player", and a person who provides the game machine G to the player or a person who manages the maintenance of the game machine are collectively referred to as "the user". Schematic configurations of the center server CS, the chassis K, and the self-propelled body D will be described below.

Figure 3:
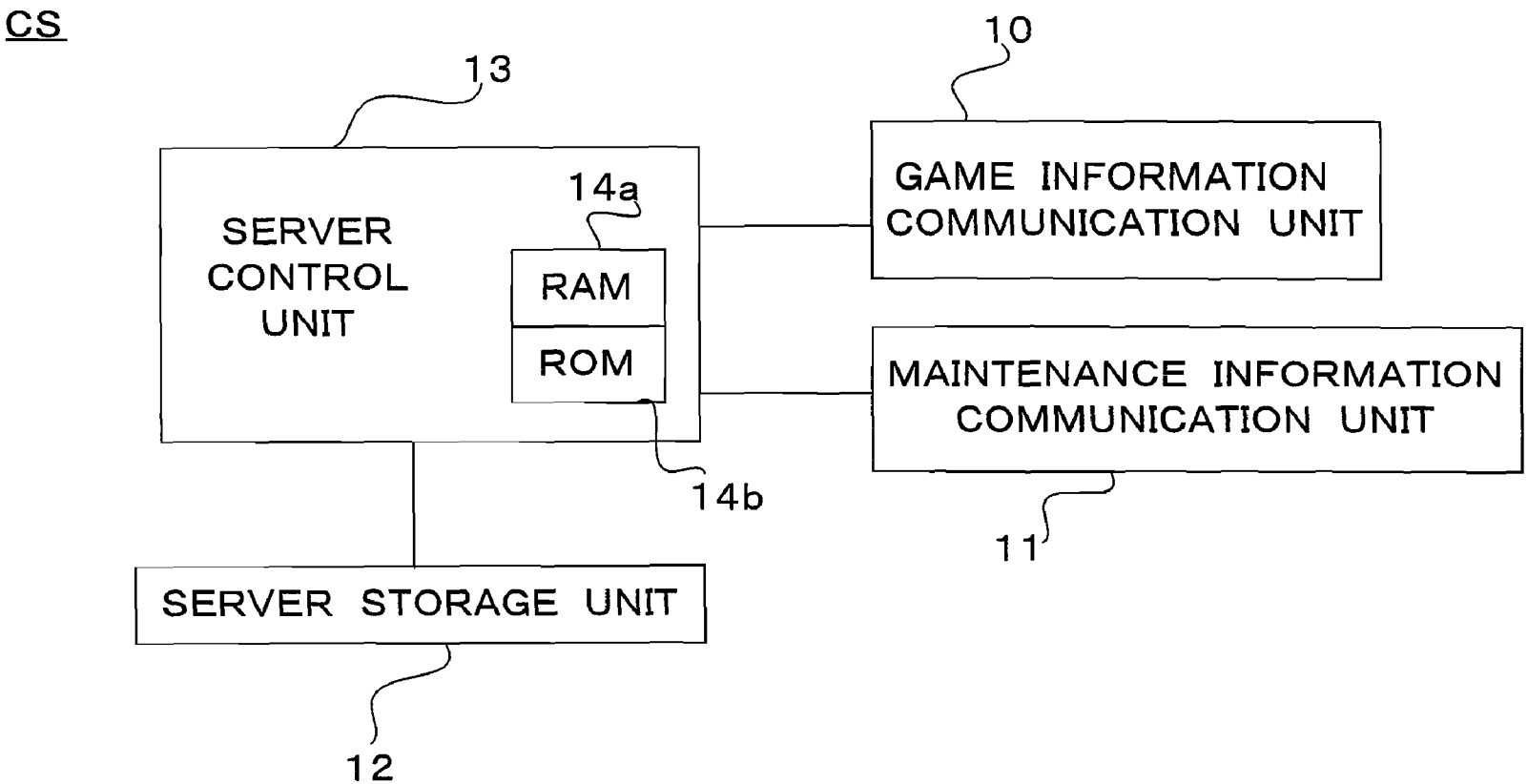
FIG. 3 is a diagram showing a schematic configuration of a center server.

The schematic configuration of the center server CS will be described with reference to FIG. 3. The center server CS has a game information communication unit 10 which transmits and receives various pieces of information to and from the game machine G, a maintenance information communication unit 11 which transmits information on the maintenance to the maintenance server MS, a server storage unit 12 which comprises a rewritable nonvolatile storage memory, and a server control unit 13 which controls the operation of each configuration provided in the center server CS. The server control unit 13 may be a computer including a CPU and various peripheral circuits such as a RAM 14*a* and a ROM 14*b* which are necessary for the CPU's operation.

Figure 4:
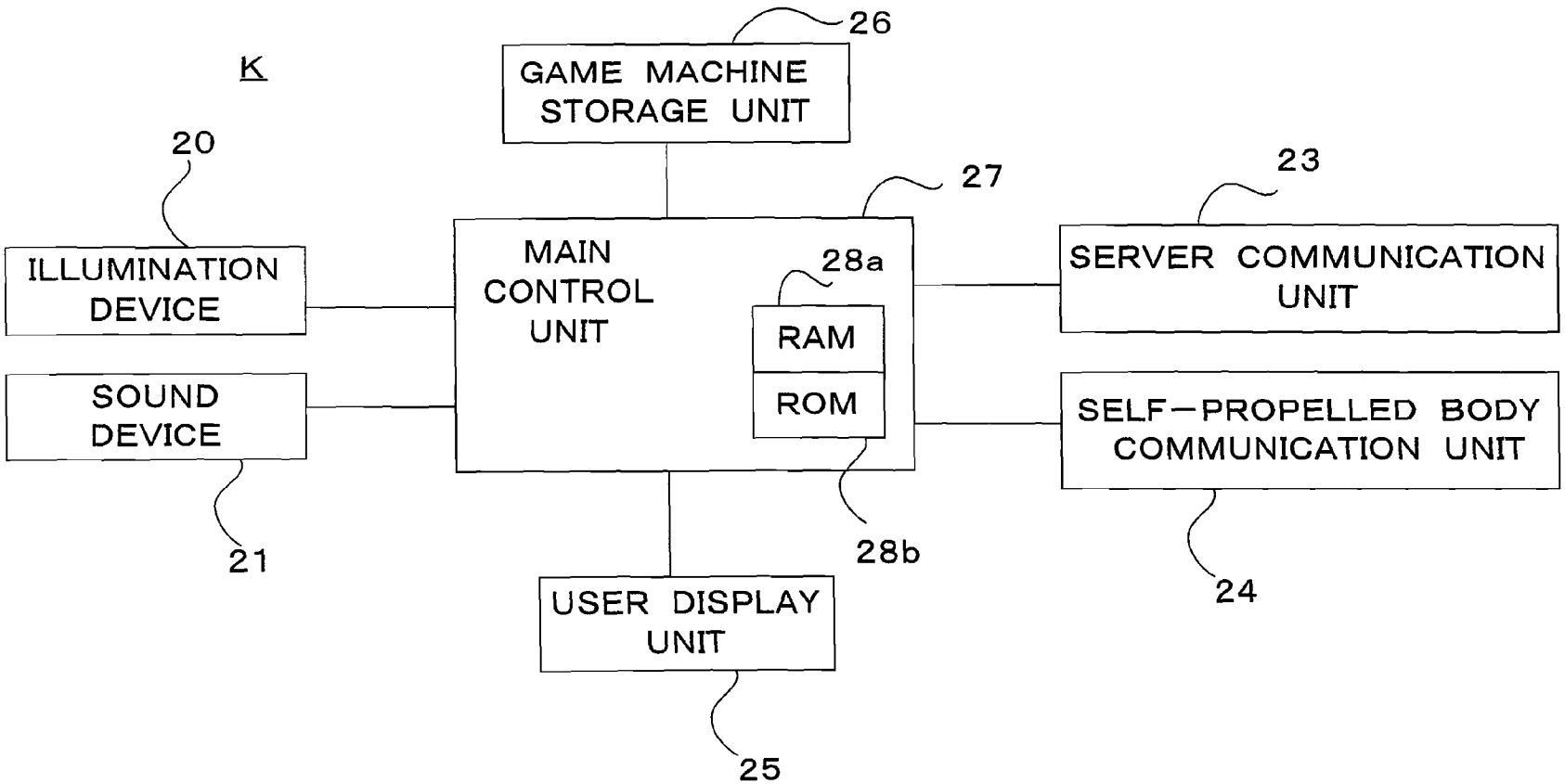
FIG. 4 is a diagram showing a schematic configuration of a chassis.

The schematic configuration of the chassis K will be described with reference to FIG. 4. The chassis K includes an illumination device 20 and a sound device 21 which are used for enliving the game, a server communication unit 23 which transmits and receives various pieces of information to and from the center server CS, a self-propelled body communication unit 24 as a communication device which transmits and receives various pieces of information to and from the self-propelled body D, a user display unit 25 on which various pieces of information are displayed to the user, a game machine storage unit 26 which comprises the rewritable nonvolatile storage memory, and a main control unit 27 which controls the operations of the configurations provided in the game machine G. The main control unit 27 may be a so-called personal computer including a CPU and various peripheral circuits such as a RAM 28*a* and a ROM 28*b* which are necessary for the CPU's operation.

A program necessary for the operation of the chassis K and a game machine ID are stored in the ROM 28*b*. The game machine ID is game machine identification information which is uniquely given to each game machine G in the game system GS. Thereby, the ROM 28*b* functions as the game machine storage device. Any display unit on which various pieces of information can be recognized by the user may be used as the user display unit 25, and the user display unit 25 includes a monitor, a printer and the like. Various pieces of data such as a D code are stored in the game machine storage unit 26. The D code is uniquely given in the game system GS to a store where the game machine G is installed. Furthermore, to the main control unit 27, a device (not illustrated) for transmitting and receiving data from and to each station S, and a player display unit (not illustrated) for providing information concerning of the game to the players through a large screen are connected.

Figure 5:
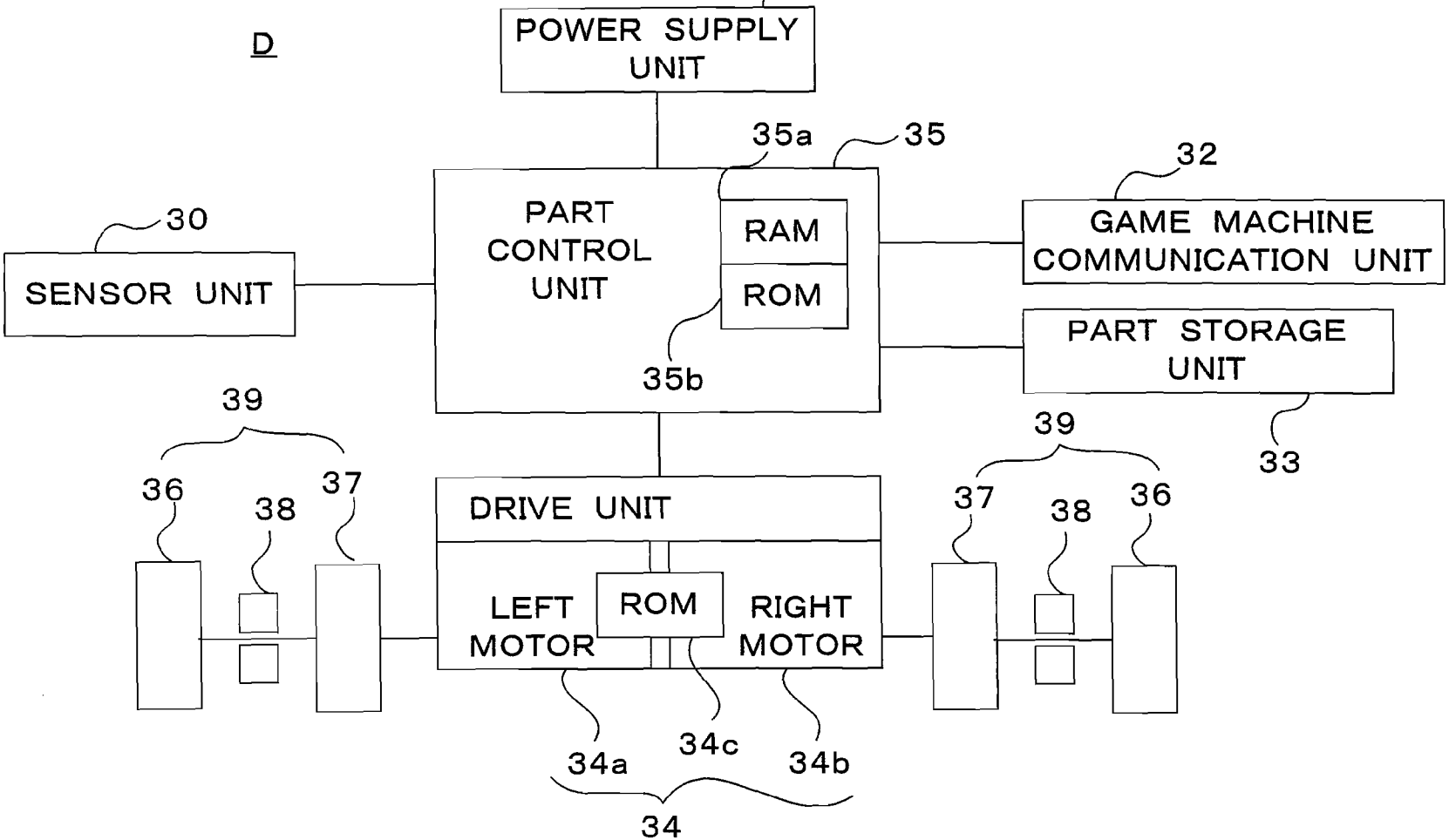
FIG. 5 is a diagram showing a schematic configuration of the self-propelled body.

The schematic configuration of the self-propelled body D will be described with reference to FIG. 5. The self-propelled body D includes a sensor unit 30 which includes various sensors for detecting operations of the self-propelled body D, a power supply unit 31 which supplies the electric power, a part storage unit 33 which comprises the rewritable nonvolatile storage medium, a drive unit 34 which comprises a motor unit, a game machine communication unit 32 as a part information output device and a game machine communication device for transmitting and receiving various pieces of information to and from the game machine G, and a part control unit 35 as an operation control device for controlling the operations of the various configurations provided in the self-propelled body D. The motor unit 34 includes a left motor 34*a* and a right motor 34*b*. Tires 36 are connected to motors 34*a* and 34*b* through gear mechanisms 37 respectively, and a bearing 38 is provided in a shaft of the tire 36 to support the shaft.

A motor ROM 34*c* is further provided in the motor unit 34, and a motor ID is stored in the motor ROM 34*c*. The motor ID is motor identification information which is uniquely given in the game system GS to the motor unit 34. The motor ID and the self-propelled body D correspond to each other one by one, and the motor ID is used as a self-propelled body ID for identifying the self-propelled body D in the game system GS. Thereby, the motor ID functions as a part identification information, and the motor ROM 34*c* functions as a part information recording device or apart identification information storage device. In this embodiment, the tire 36 and the gear mechanism 37 constitute a gear unit 39.

A sensor for position control of the self-propelled body D, a sensor for operation control, and the like are provided in the sensor unit 30. Each sensor will be described later. Various pieces of data such as status parameters and trouble parameters which are used in the later-mentioned process are stored in the part storage unit 33. Thereby, the part storage unit 33 functions as a status information storage device. The data stored in the part storage unit 33 will be described in detail later. The part control unit 35 includes a CPU and various peripheral circuits such as a RAM 35*a* and a ROM 35*b* which are necessary for the CPU's operation. As described above, because the race is performed with the six model horses, the six self-propelled bodies D having the same configuration are provided in one game machine G.

A status confirmation system, a replacement time notification system, and a trouble notification system which are performed in the game system will sequentially be described below. In each process described below, processes performed in the self-propelled body D are controlled by the part control unit 35, processes performed in the chassis K are controlled by the main control unit 27, and processes performed in the center server CS are controlled by the server control unit 13.

Figure 6:
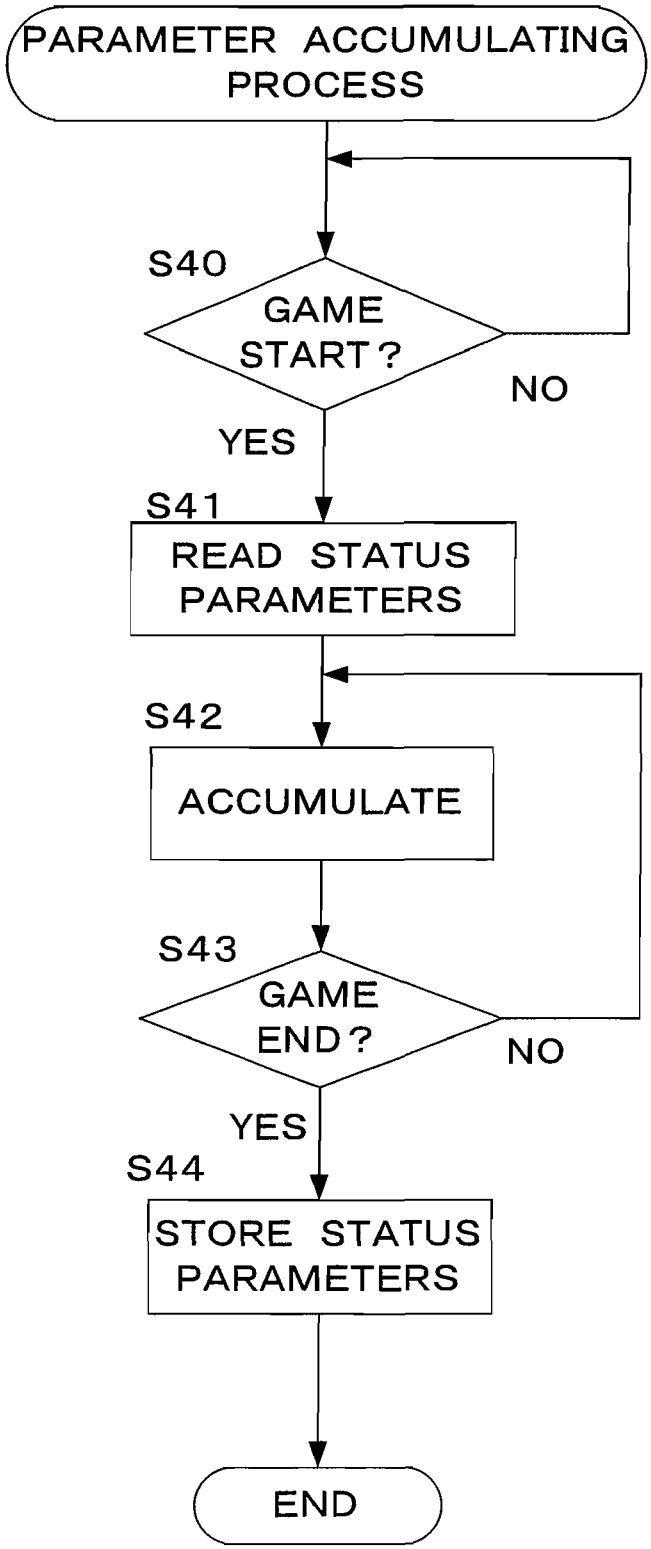
FIG. 6 is a flowchart showing a parameter accumulating process performed in the self-propelled body.

A parameter accumulating process performed during the game will be described with reference to a flowchart of FIG. 6. The parameter accumulating process is a process of updating values of status parameters indicating the status of the self-propelled body D, and the parameter accumulating process is performed by the part control unit 35 of the self-propelled body D. The status parameters include, for example, a motor operating time MH indicating a total operating time of the motor unit 34, a gear operating time GH indicating a total operating time of the gear unit 39, the number of motor revolutions MR which is of the total number of motor revolutions of each of the motors 34*a* and 34*b*, and a travel distance RD. Hereinafter the mentioned status parameters are collectively referred to as "the status parameters". The status parameters are stored in the part storage unit 33. First, the part control unit 35 determines whether or not the situation is a game start until the part control unit 35 determines that the situation is the game start (Step S40). In the case where start information indicating the game start is transmitted from the chassis K and the self-propelled body D receives the start information, the part control unit 35 determines that the situation is the game start.

When determining that the situation is the game start, the part control unit 35 reads the status parameters from the part storage unit 33 (Step S41). After the status parameters are read, the value of each status parameter is accumulated according to the operation of the self-propelled body D in the game (Step S42) . Specifically, the operation of the motor unit 34 is detected by the motor operating sensor, the duration of detecting the operation is measured and added to the motor operating time BH, and thereby the motor operating time BH is obtained. The operation of the gear unit 39 is detected by the gear operating sensor, the duration of detecting the operation is measured and added to the gear operating time GH, and thereby the gear operating time GH is obtained.

The revolutions of the motors 34*a* and 34*b* are detected by the motor revolution sensor, the number of revolutions is counted and added to the number of motor revolutions MR while the revolution is detected, and thereby the number of motor revolutions MR is obtained. The travel distance RD is obtained from the number of motor revolutions MR. Thereby, the status parameters function as the parameters indicating the used amount of the game part. By step S42, the part control unit 35 functions as a measurement device and an accumulation device. The part control unit 35 includes a counter and a timer to function as the measurement device.

After the game starts, the part control unit 35 determines whether or not the situation is a game end until the part control unit 35 determines that the situation is the game end (Step S43). In the case where end information indicating the game end is transmitted from the chassis K and the self-propelled body D receives the end information, the part control unit 35 determines that the situation is the game end. When determining that the situation is the game end, the part control unit 35 stores the status parameters updated during the game in the part storage unit 33 to end the parameter accumulating process (Step S44).

Figure 7:
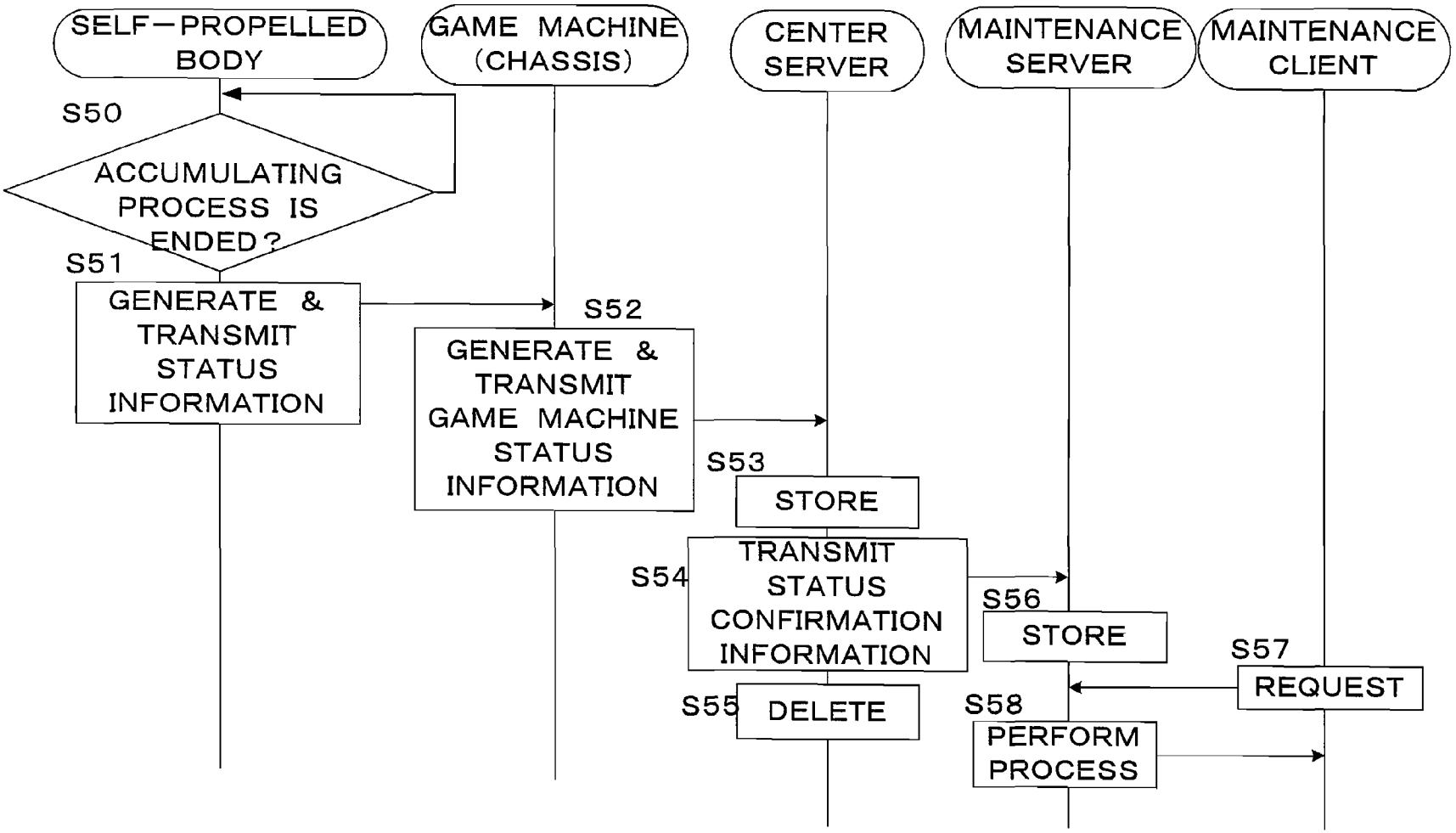
FIG. 7 is a sequence diagram showing a status confirmation system performed in the game system shown in FIG. 1.

The status confirmation system performed after the parameter accumulating process will be described with reference to the sequence diagram of FIG. 7. The status confirmation system is a system for enabling to confirm to which game machine G in the game system GS a specific self-propelled body D is provided and what the status of the specific self-propelled body D is like. Hereinafter the confirmation of the game machine G to which the self-propelled body D is provided and the confirmation of the status of the self-propelled body D are referred to as the "status confirmation". The part control unit 35 determines whether or not the parameter accumulating process is ended in the self-propelled body D (Step S50). Thereby, the part control unit 35 functions as an information output control device. When the part control unit 35 determines that the parameter accumulating process is ended, the self-propelled body D generates status information including the self-propelled body ID of itself being correlated with the status parameters stored in the part storage unit 33, and the status information is transmitted to the chassis K through the game machine communication unit 32 (Step S51). Thereby, the part control unit 35 and the game machine communication unit 32 function as a part information output device.

When the chassis K receives the status information from the self-propelled body D through the self-propelled body communication unit 24, the chassis K generates game machine status information in which the game machine ID of the self-propelled body D is correlated with the received status information, and the chassis K transmits the game machine status information to the center server CS through the server communication unit 23 (Step S52). Thereby, the self-propelled body communication unit 24 functions as a part information obtaining device, and the server communication unit 23 functions as the server transmission device. For example, the chassis K transmits the game machine status information, in which the game machine ID of the chassis K is correlated with the accumulated status information received from all the self-propelled bodies D provided to the chassis K, to the center server CS.

The center server CS stores the received game machine status information in the server storage unit 12 (Step S53). That is, both of the status parameters correlated with the game machine ID and the self-propelled body ID are stored in the server storage unit 12. When the status information correlated with the game machine ID included in the received game machine status information has already existed in the server storage unit 12, the status information existing in the server storage unit 12 is updated by the status information of the received game machine status information. The center server CS transmits to the maintenance server MS periodically, e.g., at the fixed time every day, the data as the status confirmation information obtained by copying the game machine status information stored in the server storage unit 12 (Step S54).

The center server CS deletes the game machine status information, which is transmitted to the maintenance server MS, from the server storage unit 12 (Step S55). The maintenance server MS stores the received status confirmation information in the maintenance storage unit MDB (Step S56). When the maintenance client MC makes a request about the status confirmation information to the maintenance server MS as appropriate (Step S57), the maintenance server MS performs a process corresponding to the request based on the status confirmation information stored in the maintenance storage unit MDB (Step S58). Examples of the process corresponding to the request include a process of displaying the status confirmation information on the display device of the maintenance client MC in the form of a list, a process of down-loading the status confirmation information to the maintenance client MC, and various processes of analyzing the status confirmation information. In the game system GS, the type of the status parameter is recognized by, e.g., a status code corresponding to each status parameter.

Figure 8:
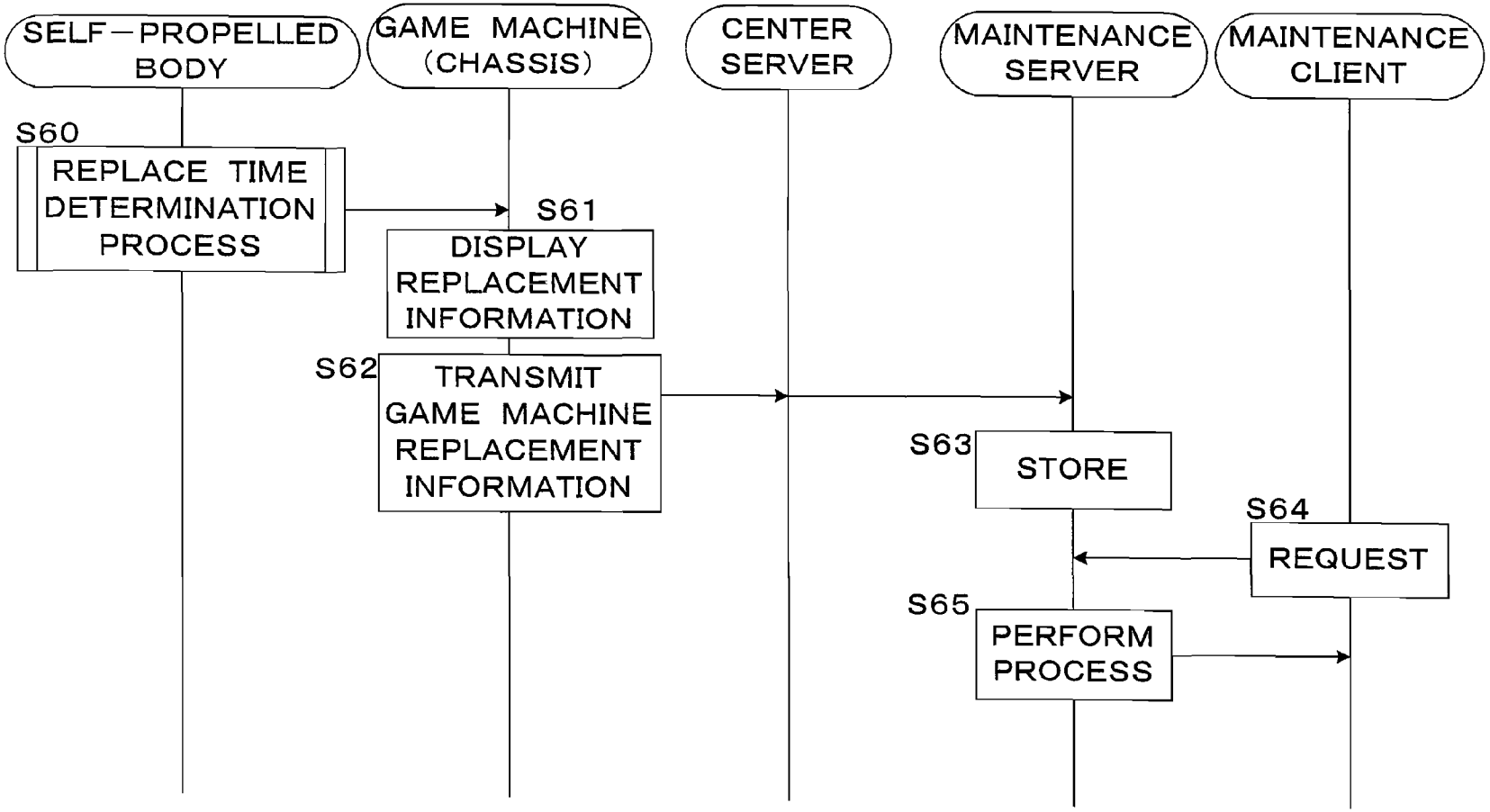
FIG. 8 is a sequence diagram showing a replacement time notification system performed in the game system shown in FIG. 1.

The replacement time notification system performed after the parameter accumulating process will be described with reference to the sequence diagram of FIG. 8. The user can appropriately be notified of the replacement time to replace the consumable item included in the self-propelled body D by the replacement time notification system. Examples of the consumable item of the self-propelled body D include the gear unit 39, the bearing 38, a power supply pin, and a brush, and so on. In this embodiment, the gear unit 39 and the bearing 38 will be described. A replacement time determination process is performed in the self-propelled body D (Step S60). When the part control unit 35 determines that it is the replacement time in the replacement time determination process, the replacement information is transmitted from the self-propelled body D to the chassis K. The replacement time determination process will be described later. The replacement information includes the self-propelled body ID and consumable item information indicating a replacing object, as described later.

The replacement information transmitted from the self-propelled body D is received by the chassis K. Thereby, the self-propelled body communication unit 24 functions as a replacement information obtaining device. The chassis K displays contents of the obtained replacement information on the user display unit 25 (Step S61), and the chassis K transmits to the center server CS through the server communication unit 23, the game machine replacement information in which the game machine ID of the chassis K is correlated with the replacement information (Step S62). Thereby, the main control unit 27 functions as a replacement processing device. In the chassis K, the replacement information may be displayed according to a display request operation of the user, or the reception of the replacement information from the self-propelled body D may be used as a trigger to display the replacement information. The center server CS transmits the received game machine replacement information to the maintenance server MS. The maintenance server MS stores the received game machine replacement information in the maintenance storage unit MDB (Step S63). That is, the consumable item information correlated with the game machine ID and the self-propelled body ID is stored in the maintenance storage unit MDB.

When the maintenance client MC makes a request about the replacement information (Step S64), the maintenance server MS performs a process corresponding to the request based on the game machine replacement information stored in the maintenance storage unit DB (Step S65). Examples of the request about the replacement information include the display of the list of the replacement information and the analysis and study of the status information according to the replacement information, and so on. Therefore, for example, a user of a maintenance division causes the maintenance client MC to display the list of the replacement information to be able to confirm which consumable item in which game machine G is in a state of the replacement time. At the moment of replacing the consumable items, the user resets to an initial, the status parameter, such as the travel distance RD, to be used to compute the replacement parameter indicating a wearing level of the replaced consumable item.

Figure 9:
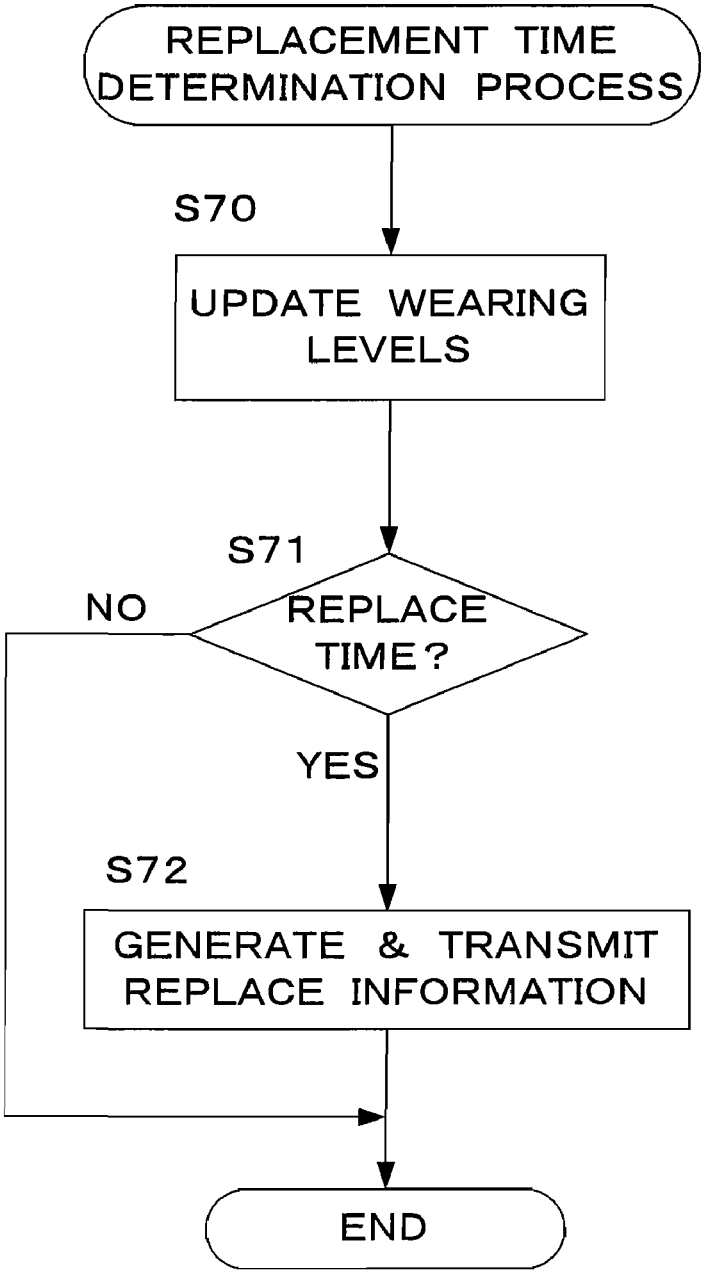
FIG. 9 is a flowchart showing a replacement time determination process performed in the self-propelled body.

The replacement time determination process performed in the self-propelled body D will be described with reference to the flowchart of FIG. 9. The part control unit 35 updates a replacement parameter 1 indicating the wearing level of the gear unit and a replacement parameter 2 indicating the wearing level of the bearing based on the values of the status parameters stored in the part storage unit 33 (Step S70). For example, in this embodiment, each of the replacement parameters 1 and 2 is set equal to the value of the travel distance RD. From Step S70, the part control unit 35 functions as a wearing level specifying device.

Then, the part control unit 35 determines whether or not it is the replacement time to replace the gear unit 39 and the bearing 38 based on the replacement parameters 1 and 2 (Step S71). Specifically, a criterion wearing level 1 indicating the replacement time of the gear unit 39 is checked against the value of the replacement parameter 1, and a criterion wearing level 2 indicating the replacement time of the bearing 38 is checked against the value of the replacement parameter 2. When the values of the replacement parameters 1 and 2 exceed the values of the corresponding criterion wearing levels 1 and 2, the part control unit 35 determines that it is the replacement time. Thereby, the part control unit 35 functions as a replacement determination device. Value of the travel distance RD indicating the replacement time of each of the consumable items 38 and 39 is set to each of the criterion wearing levels 1 and 2, and the criterion wearing levels 1 and 2 are stored in the part part storage unit 33 while correlated with the consumable items 38 and 39 respectively. Thereby, the part storage unit 33 functions as the criterion storage device. The values of the criterion wearing levels 1 and 2 can be set by a previously performed durability test.

When the part control unit 35 determines that it is the replacement time to replace the consumable item, the replacement information is generated and transmitted from the game machine communication unit 32 to the chassis K (Step S72) . Thereby, the game machine communication unit 32 functions as replacement information output device. The replacement information includes the self-propelled body ID of the self-propelled body D and the consumable item information. In Step S71, when the part control unit 35 determines that it is not the replacement time, the replacement time determination process is ended.

Figure 10:
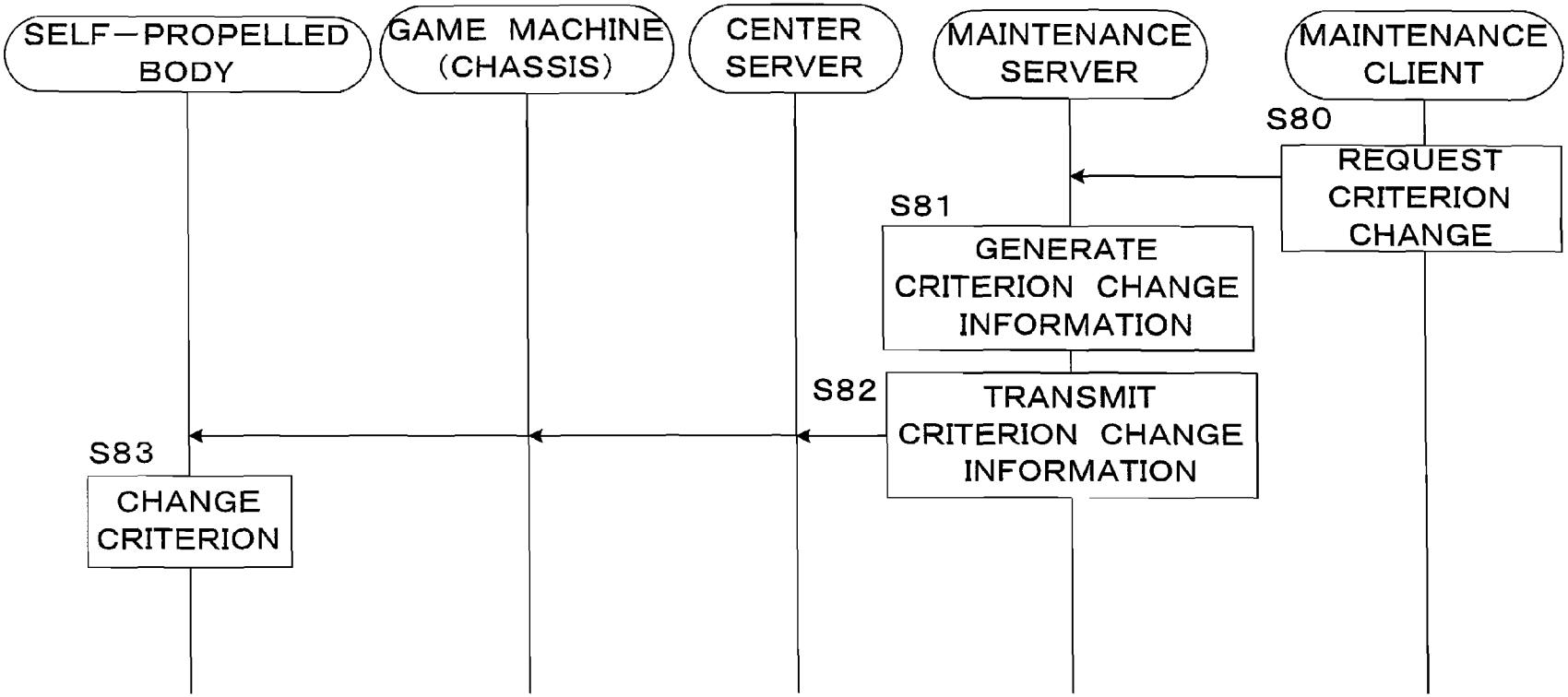
FIG. 10 is a sequence diagram showing a criterion wearing level changing system performed in the game system shown in FIG. 1.

In the game system GS, a criterion wearing level changing system which can change the criterion wearing level possessed by the self-propelled body D can be also realized by operation from the maintenance client MC. The criterion wearing level changing system will be described with reference to the sequence diagram of FIG. 10. In this embodiment, the case in which the criterion wearing level 1 of the gear unit 39 is changed will be described. A process (a criterion change request) for changing the value of the criterion wearing level 1 of the gear unit 39 is performed by the user from the maintenance client MC to the maintenance server MS (Step S80). In the maintenance server MS, criterion change information including the changed value of the criterion wearing level 1 is generated (Step S81), and the criterion change information is transmitted to the center server CS (Step S82). The center server CS transmits the received criterion change information to each chassis K.

The chassis K which received the criterion change information from the center server CS transmits the criterion change information to each self-propelled body D. Thereby, the main control unit 27 and the self-propelled body communication unit 24 function as a change information output device. In the self-propelled body D which receives the criterion change information through the game machine communication unit 32 as a change information obtaining device, the value of the criterion wearing level 1 stored in the part storage unit 33 is updated to the value of the criterion wearing level 1 included in the received criterion change information (Step S83). Thereby, the criterion wearing level 1 possessed by the self-propelled body D is changed to the value requested for changing to by the user to the maintenance client MC. From Step S83, the part control unit 35 functions as the criterion change device. The similar process is performed to change the criterion wearing level 2 of the bearing 38. In the game system GS, the type of the consumable item and the type of the criterion wearing level which are indicated by the consumable item information are recognized by codes respectively.

Figure 11:
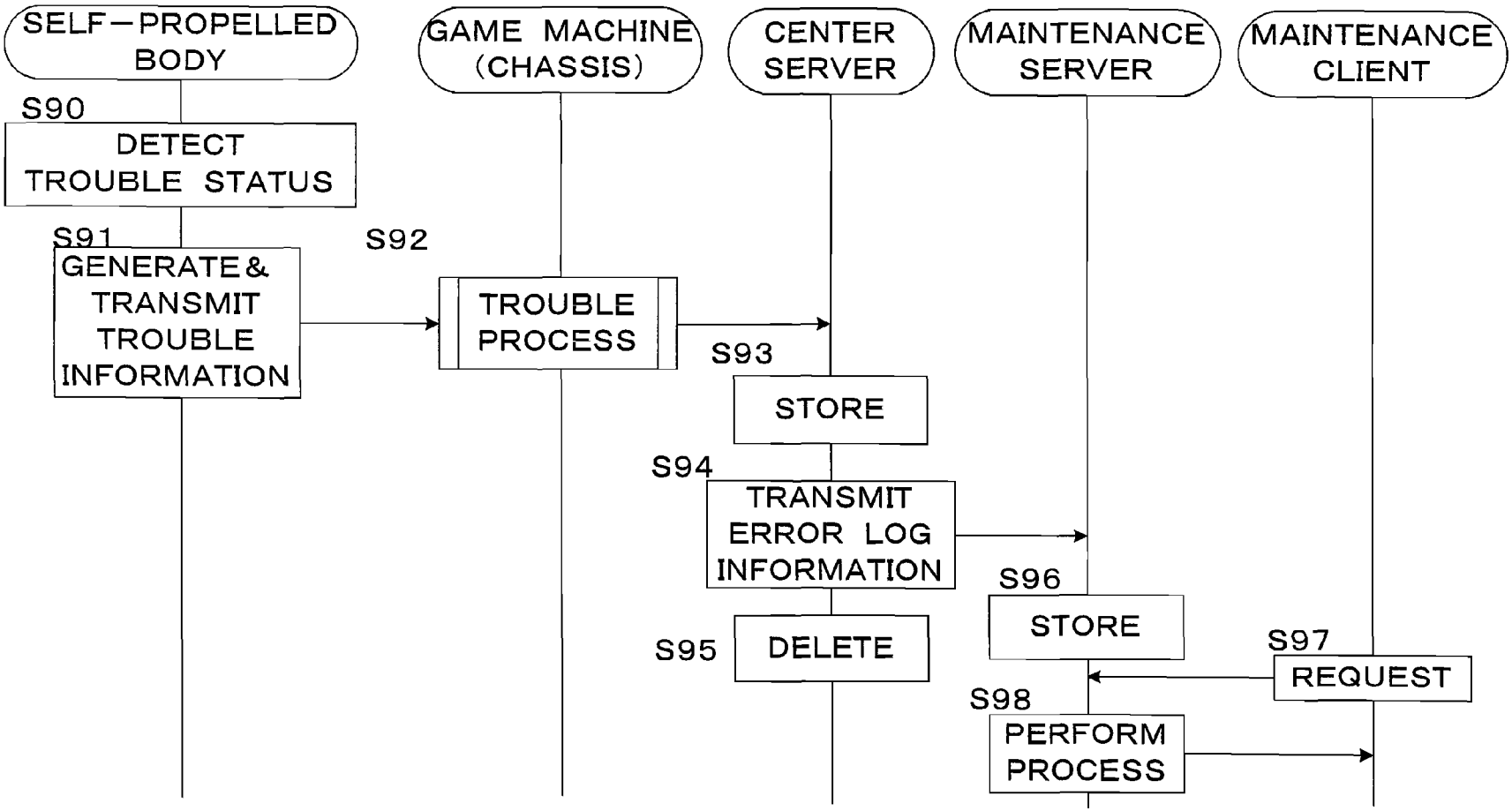
FIG. 11 is a sequence diagram showing a trouble notification system performed in the game system shown in FIG. 1.

Finally, the trouble notification system will be described with reference to the sequence diagram of FIG. 11. The trouble notification system is a system which notifies the user of a trouble status of the game machine G. Each sensor of the self-propelled body D detects the trouble status during the game (Step S90) . When the trouble status is detected, the part control unit 35 generates trouble information including the detected trouble status and the self-propelled body ID of the self-propelled body D and the part control unit 35 transmits the trouble information to the chassis K (Step S91). Examples of the trouble status include out of line, overturn, move delay, power failure, and so on. For example, the trouble information indicating the out of line when a line sensor detects that the self-propelled body D runs out of the course, and the trouble information indicating the overturn when a gyro sensor detects that the self-propelled body D is overturned. The determination of the out of line detected by the line sensor and the determination of the overturn detected by the gyro sensor can be performed by the conventional method. In the game system GS, the type of the trouble status is recognized by a trouble code indicating the trouble status.

During the game, a trouble process is performed in the chassis K (Step S92). The trouble process will be described later. In the trouble process, the later-mentioned warning information or error notification is transmitted to the center server CS in the predetermined case. The center server CS stores the received warning information or error notification as error log information in the server storage unit 12 (Step S93). That is, a value of trouble parameters and error numbers each being correlated with the self-propelled body ID and the game machine ID are stored in the server storage unit 12 as the error log information. The trouble parameters and the error numbers will be described later. The center server CS periodically generates copy data of the error log information stored in the server storage unit 12 and transmits the copy data to the maintenance server MS (Step S94). Then, the center server CS deletes the error log information, transmitted to the maintenance server MS, from the server storage unit 12 (Step S95). The maintenance server MS stores the received error log information in the maintenance storage unit MDB as error history information (Step S96).

The maintenance client MC makes a request about the error log information to the maintenance server MS as appropriate (Step S97). In the maintenance server MS, a process corresponding to the request from the maintenance client MC is performed based on the error history information stored in the maintenance storage unit MDB (Step S98). For example, the request about the error log information includes a display of a list obtained by statistically processing the pieces of error log history information within a predetermined period, and the like. FIGS. 12 to 14 show examples of the list obtained by statistically processing the pieces of error log history information. FIG. 12 shows a list with respect to error generation information in each store. Only the information on the error correlated with the specific D code can be extracted from the error log history information to display the list.

FIG. 13 shows a list of the number of error occurrences and the number of warning occurrences in each store on a specific day. The number of error occurrences means the number of times in which the error notification is transmitted from the chassis K, and the number of warning occurrences means the number of times in which the warning information is transmitted from the chassis K. FIG. 14 shows a list of the values of the trouble parameters for each self-propelled body. As shown in FIG. 14, also the values of the status parameters obtained from the status confirmation information may simultaneously be displayed in the list of the trouble parameters.

Figure 15:
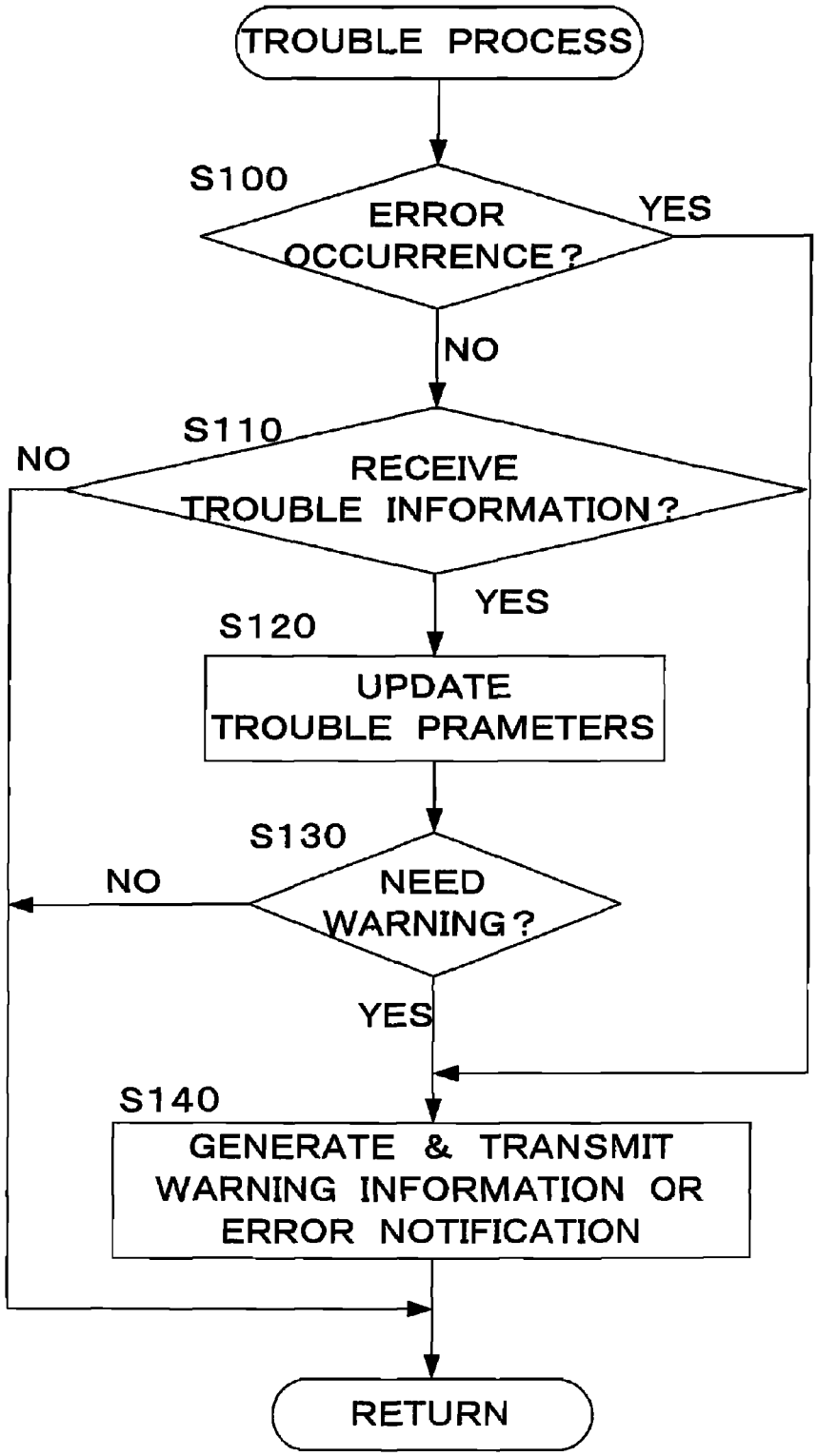
FIG. 15 is a flowchart showing a trouble process performed in chassis.

The trouble process performed in the chassis K will be described with reference to the flowchart of FIG. 15. The main control unit 27 determines whether or not the chassis K is in the error occurrence status (Step S100). The term of "error occurrence" shall mean the trouble status in which it becomes impossible to continue the game and the game is stopped. When the main control unit 27 determines that the chassis K is not in the error occurrence status, the main control unit 27 determines whether or not the trouble information is received from the self-propelled body D (Step S110). When the main control unit 27 determines that the trouble information is received, the main control unit 27 updates the value of the trouble parameters corresponding to the trouble status indicated by the received trouble information (Step S120). Examples of the trouble parameter corresponding to the trouble status include an out of line LO, an overturn TO, a move delay MD, and a power failure PF and so on. Hereinafter they are referred to as "the trouble parameter" except for when the distinction is needed. The trouble parameter is the accumulation value of the number of occurrences of the trouble status corresponding to the trouble parameter. For example, the value of the out of line LO is incremented by one when the received trouble information indicates the out of line.

Then, the main control unit 27 determines whether or not it is needed to give a warning of the trouble status corresponding to the updated trouble parameter to the center server CS (Step S130). For example, when the value of the updated trouble parameter exceeds a predetermined criterion value, the main control unit 27 determines that it is needed to give the warning. The trouble parameters and the criterion values corresponding to the trouble parameters are previously stored in the game machine storage unit 26.

In Step S130, when the main control unit 27 determines that it is needed to give the warning to the center server CS, warning information is generated and transmitted (Step S140) . The warning information includes the self-propelled body ID, the game machine ID, the D code, the trouble parameter, transmission data and time, and so on. In Step S100, the main control unit 27 determines that the error has occurred, the error notification including the error number capable of identifying the type of error instead of the trouble parameter is generated and transmitted to the center server. The above mentioned trouble process is repeated while the game is performed in the game machine G.

The invention is not limited to the above embodiment, and can be performed in various embodiments. For example, the self-propelled body ID may be stored as the unique identification ID of the self-propelled body in the ROM of the self-propelled body. In the status confirmation system, the transmission of the status information is not limited to the time when the game ends, but the status information may be transmitted when the notification such as the request of self-propelled body ID is received from the chassis or the status information may periodically be transmitted, irrespective of the game. In the status confirmation system, a sensor for detecting the status of the chassis of itself and parameters indicating the status of the chassis based on the sensor are provided and the parameters can be included as the status information on the chassis in the game machine status information. The game machine status information can be transmitted for each provided self-propelled body.

With respect to the change of the criterion wearing level, by including a specific game machine ID or a specific self-propelled body ID in the criterion change information, the criterion change level only for the specific game machine ID or the specific self-propelled body ID can be changed. The replacement information can include replacement time information on the replacement time. For example, the replacement time information can be information indicating in the stepwise manner that the replacement time draws near according to the value of the computed replacement parameters.

The status of the power supply surface can also be confirmed by the trouble notification system. For example, in the list of FIG. 14, when the power failure state occurs in all the self-propelled bodies provided in the same game machine, it can be determined that there is a trouble with the power supply surface. Either a public line or a dedicated line can be used as the communication network, and both a wired line and wireless line can be applied. In this embodiment, the game machine transmits and receives the data to and from only the center server through the communication network. Alternatively, the game machine may directly transmit and receive the data to and from the maintenance server. The center server and the maintenance server may be directly connected without passing through the communication network.

The invention claimed is:

1. A game system having a game machine in which a predetermined game is performed, the game machine having a game machine main body and a replaceable game part provided in the game machine main body to be used in the game machine, the game part having a consumable item which is replaceable and consumed by use in the game, wherein the game part comprises:

a criterion storage device storing a criterion wearing level indicating a wearing level at which the consumable item should be replaced;

a measurement device measuring a parameter indicating a used amount of the game part in the game;

an accumulation device accumulating a value of the parameter measured by the measurement device;

a wearing level specifying device specifying the wearing level of the consumable item of the game part based on an accumulation value obtained by the accumulation device;

a replacement determination device checking the wearing level specified by the wearing level specifying device to the criterion wearing level of the criterion storage device to determine whether or not replacement time comes to replace the consumable item and a replacement information output device outputting replacement information on replacement of the consumable item to the game machine main body, when the replacement determination device determines that i-t replacement time comes to replace the consumable item, and the game machine main body comprising:

a replacement information obtaining device obtaining the replacement information outputted from the game part; and a replacement processing device performing a process concerning a replacement of the consumable item of the game part based on the replacement information obtained by the replacement information obtaining device, the game part having output the replacement information.

2. The game system according to claim 1, wherein the game machine main body further comprises a server communication device capable of transmitting and receiving data to and from a server through a communication network, and wherein the replacement processing device of the game machine main body notifies a user of information on the replacement of the consumable item based on the obtained replacement information, and transmits the replacement information to the server.

3. The game system according to claim 2, wherein the game part is a movable body, the game machine main body comprises a part communication device transmitting and receiving control information on operation control of the game part to and from the game part, and the game part further comprises:

a game machine communication device transmitting and receiving the control information on operation control of the game part to and from the game machine main body; and an operation control device controlling operation of the game part based on the control information transmitted from the game machine main body.

4. The game system according to claim 3, wherein the game machine further comprises a traveling surface, and the game part is a self-propelled body traveling on the traveling surface.

5. The game system according to claim 2, wherein the game machine main body further comprises a game machine storage device storing game machine identification information uniquely given to each game machine in the game system, and wherein the replacement processing device transmits to the server, the replacement information including the game machine identification information of the game machine corresponding thereto.

6. The game system according to claim 5, wherein the server transmits to the game machine main body, criterion change information including information for changing the criterion wearing level, the game machine main body further comprises:

a change information output device for outputting the criterion change information to the game part at the moment of receiving the criterion change information from the server, and the game part further comprises:

a change information obtaining device obtaining the criterion change information from the game machine main body; and a criterion change device changing the criterion wearing level stored in the criterion storage device based on the criterion change information obtained by the change information obtaining device.

7. The game system according to claim 6, wherein the game part further comprises a part identification information storage device storing part identification information uniquely given to each game part in the game system, the replacement information output device transmits to the game machine main body, the replacement information including the part identification information of the game part corresponding thereto, the criterion change device, when the criterion change information includes the part identification information of the game part corresponding thereto, changes the criterion wearing level based on the criterion change information, and the criterion change information transmitted from the server includes the part identification information corresponding to the game part in which the criterion wearing level of a changing object is stored.

8. The game system according to claim 7, wherein the game part is a movable body, the game machine main body further comprises a part communication device transmitting and receiving control information on operation control of the game part to and from the game part, and the game part further comprises:

a game machine communication device transmitting and receiving the control information on operation control of the game part to and from the game machine main body; and an operation control device controlling operation of the game part based on the control information transmitted from the game machine main body.

9. The game system according to claim 6, wherein the game part is a movable body, the game machine main body further comprises a part communication device for transmitting and receiving control information on operation control of the game part to and from the game part, and the game part further comprises:

a game machine communication device transmitting and receiving the control information on operation control of the game part to and from the game machine main body; and an operation control device controlling operation of the game part based on the control information transmitted from the game machine main body.

10. The game system according to claim 5, wherein the game part is a movable body, the game machine main body further comprises a part communication device transmitting and receiving control information on operation control of the game part to and from the game part, and the game part further comprises:

a game machine communication device transmitting and receiving the control information on operation control of the game part to and from the game machine main body; and an operation control device controlling operation of the game part based on the control information transmitted from the game machine main body.

11. The game system according to claim 10, wherein the game machine has a traveling surface, and the game part is a self-propelled body traveling on the traveling surface.

12. The game system according to claim 2, wherein the server transmits to the game machine main body, criterion change information including information for changing the criterion wearing level, the game machine main body further comprises a change information output device outputting the criterion change information to the game part at the moment of receiving the criterion change information from the server, and the game part further comprises:

a change information obtaining device obtaining the criterion change information from the game machine main body; and a criterion change device changing the criterion wearing level stored in the criterion storage device based on the criterion change information obtained by the change information obtaining device.

13. The game system according to claim 12, wherein the game part further comprises a part identification information storage device storing part identification information uniquely given to each game part in the game system, the replacement information output device transmits to the game machine main body, the replacement information including the part identification information of the game part corresponding thereto, the criterion change device, when the criterion change information includes the part identification information of the game part corresponding thereto, changes the criterion wearing level based on the criterion change information, and the criterion change information transmitted from the server includes the part identification information corresponding to the game part in which the criterion wearing level of a changing object is stored.

14. The game system according to claim 13, wherein the game part is a movable body, the game machine main body further comprises a part communication device transmitting and receiving control information on operation control of the game part to and from the game part, and the game part further comprises:

a game machine communication device transmitting and receiving the control information on operation control of the game part to and from the game machine main body; and an operation control device controlling operation of the game part based on the control information transmitted from the game machine main body.

15. The game system according to claim 14, wherein the game machine has a traveling surface, and the game part is a self-propelled body traveling on the traveling surface.

16. The game system according to claim 12, wherein the game part is a movable body, the game machine main body further comprises a part communication device transmitting and receiving control information on operation control of the game part to and from the game part, and the game part further comprises:

a game machine communication device transmitting and receiving the control information on operation control of the game part to and from the game machine main body; and an operation control device controlling operation of the game part based on the control information transmitted from the game machine main body.

17. The game system according to claim 16, wherein the game machine has a traveling surface, and the game part is a self-propelled body traveling on the traveling surface.

18. The game system according to claim 1, wherein the game part is a movable body, the game machine main body further comprises a part communication device transmitting and receiving control information on operation control of the game part to and from the game part, and the game part further comprises:

a game machine communication device transmitting and receiving the control information on operation control of the game part to and from the game machine main body; and an operation control device controlling operation of the game part based on the control information transmitted from the game machine main body.

19. The game system according to claim 18, wherein the game machine has a traveling surface, and the game part is a self-propelled body traveling on the traveling surface.

20. A game part replaceably provided in a game machine to be used in a game, which is performed in the game machine, and having a replaceable consumable item to be consumed by use in the game, the game part comprising:

a criterion storage device storing a criterion wearing level indicating a wearing level at which the consumable item should be replaced;

a measurement device measuring a parameter indicating a used amount of the game part in the game;

an accumulation device accumulating a value of the parameter measured by the measurement device; a wearing level specifying device specifying the wearing level of the consumable item of the game part based on an accumulation value determined by the accumulation device;

a replacement determination device checking the wearing level specified by the wearing level specifying device to the criterion wearing level of the criterion storage device to determine whether or not replace time comes to replace the consumable item; and a replacement information output device outputting replacement information on replacement of the consumable item to the game machine main body, when the replacement determination device determines that it is replace time comes to replace the consumable item.

* * * * *